US006489870B1

(12) United States Patent
Ward et al.

(10) Patent No.: US 6,489,870 B1
(45) Date of Patent: Dec. 3, 2002

(54) SOLENOID WITH IMPROVED PULL FORCE

(75) Inventors: James R. Ward, Milwaukee, WI (US); Derek A. Dahlgren, Brookfield, WI (US)

(73) Assignee: TLX Technologies, Waukesha, WI (US)

( * ) Notice: Subject to any disclaimer, the term of this patent is extended or adjusted under 35 U.S.C. 154(b) by 0 days.

(21) Appl. No.: 09/444,625

(22) Filed: Nov. 22, 1999

(51) Int. Cl.[7] ..... H01F 7/08

(52) U.S. Cl. ..... 335/220; 335/236; 335/255; 335/282

(58) Field of Search ..... 335/229–234, 335/236, 237, 255, 256, 281

(56) References Cited

U.S. PATENT DOCUMENTS

| | | | | |
|---|---|---|---|---|
| 2,352,119 A | | 6/1944 | Putt | |
| 3,805,204 A | | 4/1974 | Peterson | 335/255 |
| 4,004,343 A | | 1/1977 | Marsden | |
| 4,071,042 A | | 1/1978 | Lombard et al. | |
| 4,302,743 A | * | 11/1981 | Araki | 335/251 |
| 4,403,765 A | * | 9/1983 | Fisher | 251/65 |
| 4,686,501 A | | 8/1987 | Palmier et al. | 335/256 |
| 4,845,392 A | | 7/1989 | Mumbower | |
| 5,059,813 A | | 10/1991 | Shiroyama | 290/48 |
| 5,065,979 A | * | 11/1991 | Detweiler et al. | 251/129.16 |
| 5,330,153 A | | 7/1994 | Reiter | 251/129.21 |
| 5,340,032 A | | 8/1994 | Stegmaier et al. | 239/575 |
| 5,377,720 A | | 1/1995 | Stobbs et al. | 137/625.65 |
| 5,488,340 A | * | 1/1996 | Maley et al. | 335/253 |
| 5,518,219 A | | 5/1996 | Wenzel et al. | 251/129.15 |
| 5,538,026 A | | 7/1996 | Kazi | 137/1 |
| 5,547,165 A | | 8/1996 | Brehm et al. | 251/129.16 |
| 5,632,467 A | | 5/1997 | Just et al. | 251/129.21 |
| 5,732,888 A | | 3/1998 | Maier et al. | 239/585.1 |
| 5,915,665 A | | 6/1999 | Paese et al. | 251/30.04 |

FOREIGN PATENT DOCUMENTS

| | | |
|---|---|---|
| EP | 1059647 | 12/2000 |
| FR | 2319184 | 5/1975 |

* cited by examiner

*Primary Examiner*—Ramon M Barrera
(74) *Attorney, Agent, or Firm*—Reinhart Boerner Van Deuren, s.c.

(57) ABSTRACT

A solenoid includes a pole member of a magnetic material, the pole member including a pole end portion having a pole surface, an armature adapted for movement relative to the pole member between first and second positions and a coil assembly for positioning the armature relative to the pole member. A magnetic shunt structure, which is located adjacent to a pole surface of the pole member, includes at least one magnetic shunt member of a magnetically permeable material, bridging at least a portion of the air gap between the pole face and the armature face, when the armature is spaced apart from the pole member, to provide a low reluctance magnetic flux path between the pole member and the armature, increasing the attractive force between the armature and the pole member. The shunt member can be configured as a ring, as a washer, or as a combination of both a ring and a washer.

13 Claims, 15 Drawing Sheets

SOLENOID WITH IMPROVED PULL FORCE

BACKGROUND OF THE INVENTION

Field of the Invention

The present invention relates generally to solenoids, and more particularly, to solenoids including a magnetic flux shunt member for providing a low reluctance magnetic flux path between an armature and a pole member, for example, of the solenoid as the armature is driven to and away from a full stroke position.

Electromagnetic actuators include a solenoid coil for moving an armature relative to a pole member or an end wall of a case of the actuator, for example, in carrying out a control function. When the armature is to be driven toward the pole member, initially, a large air gap will exist between opposing faces of the armature and the pole member. The air gap provides a high reluctance path for magnetic flux produced by the solenoid coil for driving the armature toward the pole member. The high reluctance results in a reduced magnetic force, particularly at the full stroke position for the armature. Consequently, a relatively large attractive force must be produced to move the armature toward the pole member. In known actuators, producing a greater force generally requires increasing the size of the solenoid coil, and resulting in a larger size for the solenoid package.

Both the response time of the actuator and the turn-on threshold are a function of the amount of attractive force produced by the device. The amount of force which can be generated by electromagnetic actuators is related to the relative sizes of the magnetic pole and the armature, the number of turns of solenoid coil and the current that is applied to the solenoid coil. The solenoid coil size generally determines the dimensions of the device because the solenoid coil is wound on the magnetic pole. Thus, methods of maximizing the attractive force generated by such devices are usually directed to optimizing the magnetic circuit of the device.

The operating efficiencies of actuators can be increased to some extent by improving the magnetic flux coupling between the magnetic pole piece and the armature. Arrangements for improving such magnetic flux coupling in proportional actuators are disclosed in copending U.S. patent application, Ser. No. 09/205,920 of James R. Ward and Derek Dahlgren, which was filed on Dec. 4, 1998, and which is assigned to the assignee of the present application. This application, Ser. No. 09/205,920, is incorporated herein by reference. The application discloses a proportional actuator which includes a saturation tip formed on the movable armature of the actuator for directing magnetic flux through a pole piece to the armature. The saturation tip bridges the air gap that exists between the opposing surfaces of the armature and the pole piece when the armature is spaced apart from the pole piece. The actuator includes a step-wound coil which provides a region of increased diameter for accommodating the saturation tip, allowing this working diameters of the armature and the pole piece to be increased for a given size actuator, with a corresponding increase in the attractive force produced by the magnetic circuit of the device actuator.

Maximizing attractive force is an important factor in latching solenoids. Most known latching solenoids use flat face to maximize the attractive force. Another technique for improving magnetic flux coupling, and thus attractive force, between a magnetic pole piece and armature of a latching solenoid is to provide a conical shape for the armature to concentrate the flux and thereby increase the attractive force. However, the use of a conical shape results in a smaller area for latching in latching solenoids. Thus, it would be desirable to minimize the effect of the air gap for magnetic flux to cross as the armature is being driven to the latched position.

SUMMARY OF THE INVENTION

The disadvantages and limitations of the background art discussed above are overcome by the present invention. With this invention, there is provided a solenoid including a member of a magnetic material including a pole face, an armature of a magnetic material and having an armature face opposing the pole face, and a coil assembly for positioning the armature relative to the member. The armature is adapted for movement relative to the member between first and second positions, with the armature face being spaced apart from the pole face, defining an air gap when the armature is in a first position and the armature face engaging the pole face when the armature is in a second position. The solenoid further includes a magnetic flux shunt structure located adjacent to the pole face. The magnetic flux shunt structure includes at least one magnetic shunt member of a magnetically permeable material which is configured and arranged to shunt at least a portion of the air gap when the armature is in the first position to provide a low reluctance magnetic flux path between the member and the armature. The armature is movable relative to the magnetic shunt member. In one embodiment, the magnetic flux shunt structure is configured as a ring. In another embodiment, the magnetic flux shunt structure is configured as a flat washer-like member.

In preferred embodiments, the shunt member is a free floating with respect to a magnetic pole member and the armature. That is, the shunt member is not fixed or attached to the magnetic pole member or to the armature. Rather, the shunt member is positioned in relationship with the armature by an element of a non-magnetic material which can be a bobbin of the solenoid winding or a separate element, for example.

The free floating shunt member eliminates the need for tight concentricity tolerances and the need for a bearing such as that which is required for a fixed shunt ring, such as that disclosed in U.S. patent application, Ser. No. 09/205,920, referenced above. The independent shunt member allows the flatness of the pole member to be easily maintained to facilitate the obtaining optimum latching forces. In the actuators disclosed in the above-reference application, in which the shunt ring can be part of the pole member, for example, optimum operation relies on the flatness at the bottom of a counter bore in either the pole member or the armature, which is much more difficult to maintain than when the pole surface is formed by machining a flat surface that does not include an outwardly projecting annular portion encompassing the pole surface. In addition, the separate shunt ring allows the pole member and/or the armature to be made of a material that is different from the material of the shunt member. For example, in one preferred embodiment, the shunt member is of a soft material which provides for improved pull-in force from the unlatched to the latched position. The armature and the pole member can be of hardened material which provides for improved residual latching forces in the latched position.

The magnetic flux shunt structure results in greater magnetic attractive force at relatively long strokes and tends to equalize the attractive force over the length of the stoke. Accordingly, for a given size package, a larger magnetic force is obtained for the solenoid including a magnetic flux shunt structure as compared to that produced for a comparably sized solenoid without the magnetic flux shunt structure. Alternatively, a comparable force can be provided using a lower level of current for energizing the solenoid winding, allowing the use a smaller package, as compared with a comparably sized solenoid that does not include a magnetic flux shunt structure. Moreover, because a larger force is provided, the solenoid can use a stiffer bias spring, if desired.

Another advantage provided by the magnetic flux shunt structure of the present invention is that the surface areas of the pole face and of the armature face can be maximized as compared to a comparably sized solenoid that does not include a flux shunt structure.

Yet another advantage provided by the magnetic flux shunt structure is minimization of the air gap for magnetic flux to cross as the armature is being driven from the first position to the second position.

In some preferred embodiments, the solenoid is a latching solenoid, the latching mechanism being either residual magnetism or a permanent magnet in the magnetic flux path. In such application, the solenoid can include a guide member for isolating the armature from the magnetic flux shunt structure. The guide member eliminates side loading which could cause the armature to become misaligned with the flat pole face, resulting in reduction of the latching force.

Other advantages and features of the invention, together with the organization and the manner of operation thereof, will become apparent from the following detailed description when taken in conjunction with the accompanying drawings, wherein like elements have like numerals throughout the drawings.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
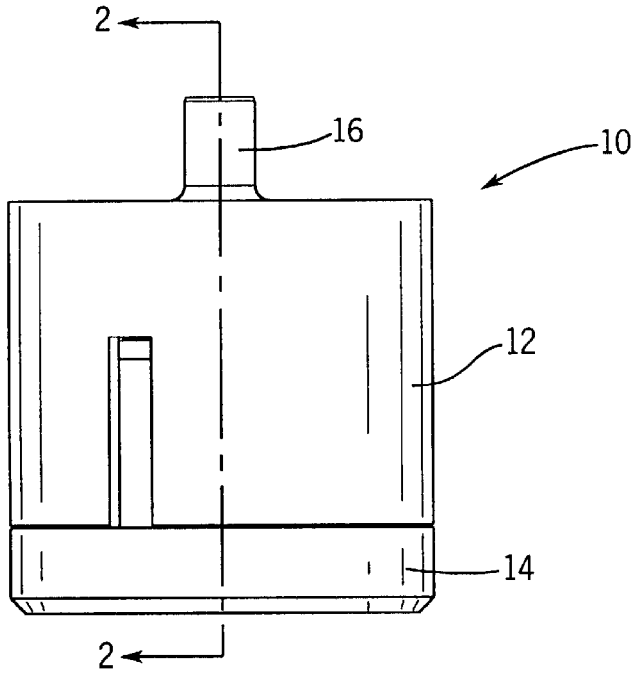
FIG. 1 is an elevation view of a latching solenoid including a magnetic flux shunt member in accordance with the present invention.
Figure 2:
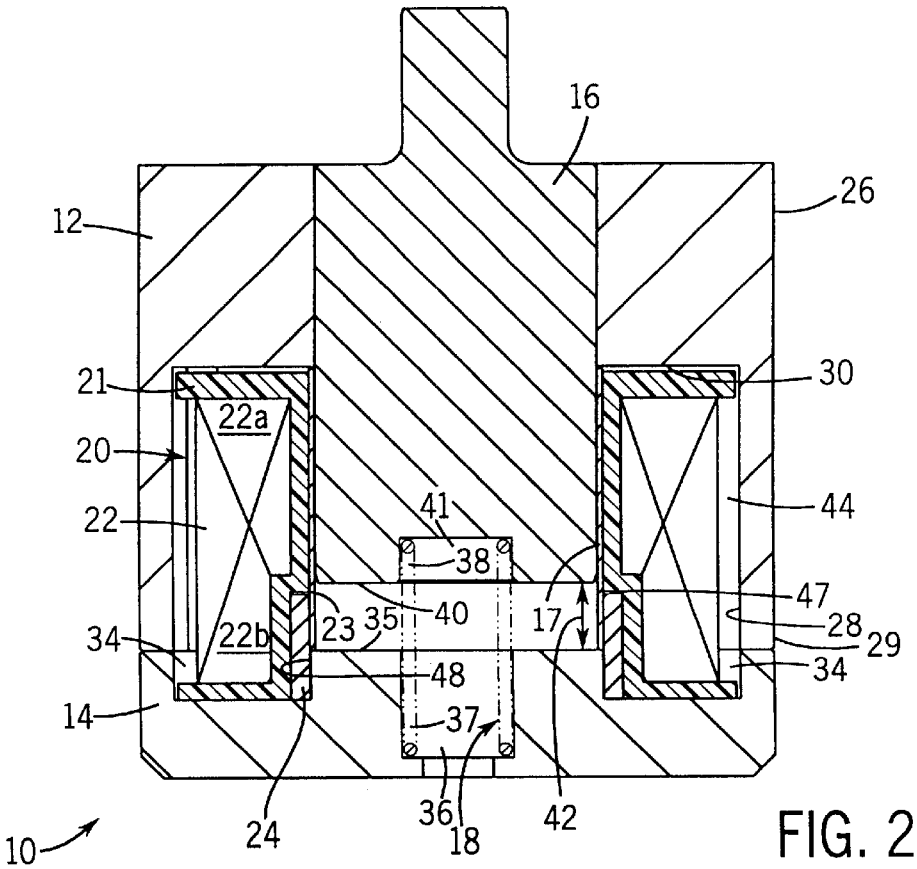
FIG. 2, is a vertical section view taken along the line 2—2 of FIG. 1.
Figure 3:
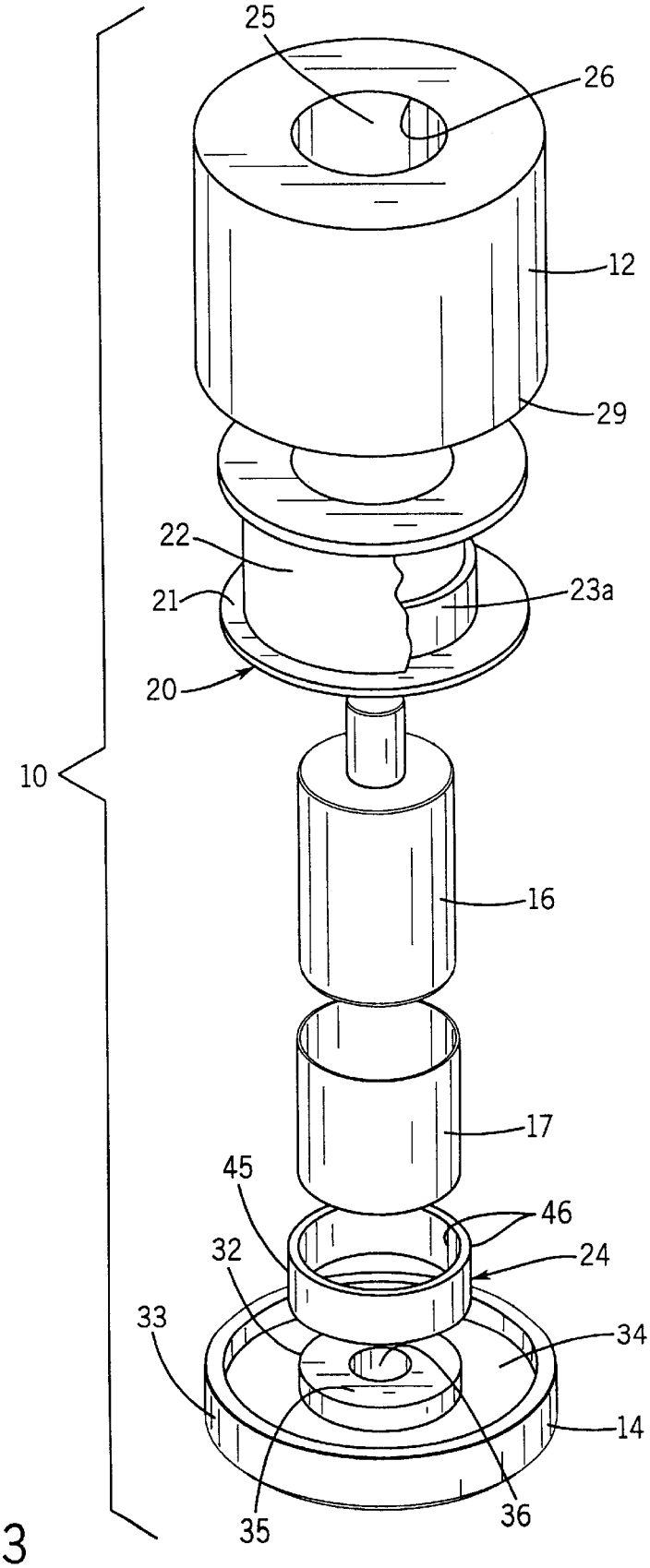
FIG. 3, is an exploded isometric view of the latching solenoid of FIG. 1, with the bias spring not being shown.

Referring to FIGS. 1–3 of the drawings, there is shown a latching solenoid 10 in accordance with one embodiment of the invention. The latching solenoid 10 includes a case or body 12, a magnetic pole member 14, an armature 16, a guide member 17, a bias spring 18 (FIG. 2) and a coil assembly 20. The bias spring 18 is interposed between the armature 16 and the pole member 14 for biasing the armature to an unlatched position, as shown in FIG. 2. The coil assembly 20 is adapted for driving the armature 16 from the unlatched position to a latched position shown in FIG. 5. In accordance with the invention, the latching solenoid 10 includes a magnetic flux shunt structure 24 for providing a low reluctance magnetic flux path between the pole member and the armature as the armature is driven toward and away from the latched position.

Considering the latching solenoid 10 in more detail, the body 12 is generally cylindrical in shape and has a through bore 25 (FIG. 3) from one end 26 of the body to the opposite end 29 of the body. The bore 25 is countersunk at end 29, defining an interior cavity 30 for the body for locating the coil assembly 20. The body 12 can be of steel or other suitable magnetic material.

The pole member 14 is a generally flat, disc-like element which includes a center hub 32 and an annular side wall 33 spaced apart from the center hub 32, defining an annular channel 34. The center hub 32 defines a generally circular pole surface or face 35 for the pole member 14. The hub 32 includes a recess 36 for locating one end 37 of the bias spring 18, as shown in FIG. 2 for example. In one embodiment, the bias spring 18 is a coil spring. The magnetic pole member 14 is mounted on the body 12 at one end 29 thereof, closing the end 29 of the body 12. The magnetic pole member 14 can be made of steel or any other suitable magnetic material. The latching solenoid 10 includes a separate magnetic pole member 14. However, the pole face can be defined by a portion, such as an end wall portion, of the body 12, in the manner described herein for other embodiments of solenoids including a shunt structure. In such embodiments, the body is a generally cup-like member and in such embodiments, an end wall of the body defines a pole face and provides the function of a magnetic pole member. Thus, in this description and in the appended claims, the term pole member should be broadly construed as reading on a separate member or a portion of the case or body of the solenoid.

The armature 16 is a generally cylindrical element which can be made of steel or some other magnetic material. The armature has an armature surface or face 40 which corresponds in shape and size to pole surface 35. The armature surface 40 includes a recess 41 which receives the other end 38 of the bias spring 18. The armature 16 is mounted in the body 12 near end 26 thereof for reciprocating movement within the body 12 relative to the pole member 14 between the latched and unlatched positions. In the latched position shown in FIG. 5, the armature surface 40 engages the pole surface 35. In the unlatched or full stroke position shown in FIG. 2, the armature surface 40 is disposed in an opposing spaced relationship with the pole surface 35 of the magnetic pole member 14, defining a working or air gap 42.

In one embodiment, residual magnetism maintains the armature in a position to which it has been driven. However, the armature can be maintained in a position to which it has been driven by a permanent magnet located in the magnetic flux path. For applications in which residual magnetism is used to maintain the armature in a position to which it is driven, the shunt structure preferably is of a soft magnetic material, such as a soft steel, and the armature, pole member and body are of a hard magnetic material, such as a hardened steel.

In one embodiment, the coil assembly 20 includes a step-wound solenoid winding 22. The solenoid winding 22 is wound on a bobbin 21 formed with a step or shoulder 23 at one end. The outer surface of the step is indicated by the reference numeral 23*a* in FIG. 3. In one embodiment, the bobbin 21 is made of plastic. The solenoid winding 22 includes a winding portion 22*a* and a winding portion 22*b* which has an inner diameter that is larger than the inner diameter of the winding portion 22*a*. The coil assembly 20 is mounted within the body 12 near end 29, located in a chamber 44 formed by the interior cavity 30 of the body and the channel 34 in the pole member 14.

In one embodiment, the shunt structure 24 is configured as a ring shaped member which preferably is a separate element from the pole member and the armature. Thus, in preferred embodiments, the shunt member is a free floating with respect to a magnetic pole member and the armature. That is, the shunt member is not fixed or attached to the magnetic pole member or to the armature. Rather, the shunt member is positioned in relationship with the armature by an element of a non-magnetic material which can be a bobbin of the solenoid winding or a separate element, for example.

The free floating shunt member eliminates the need for tight concentricity tolerances and the need for a bearing such as that which is required for a fixed shunt ring, such as that disclosed in U.S. patent application, Ser. No. 09/205,920, referenced above. The independent shunt member allows the flatness of the pole member to be easily maintained to facilitate the obtaining optimum latching forces. In the actuators disclosed in the above-reference application, in which the shunt ring can be part of the pole member, for example, optimum operation relies on the flatness at the bottom of a counter bore in either the pole member or the armature, which is much more difficult to maintain than when the pole surface is formed by machining a flat surface that does not include an outwardly projecting annular portion encompassing the pole surface. In addition, the separate shunt ring allows the pole member and/or the armature to be made of a material that is different from the material of the shunt member. For example, in one preferred embodiment, the shunt member is of a soft material which provides for improved pull-in force from the unlatched to the latched position. The armature and the pole member can be of hardened material which provides for improved residual latching forces in the latched position.

The shunt member or ring 24 has a side wall 45 with parallel side surfaces 46, as shown in FIG. 3 for example. Alternatively, the shunt ring 24 of the latching solenoid 10 shown in FIGS. 1–3 can have a beveled edge 74*a* in the manner of shunt ring 74 shown in FIG. 10. The shunt ring 24 is mounted in a channel 47 defined by the stepped portion 23 of the bobbin 21 and the inner portion of the channel 34 of the pole member 14. A first portion of the shunt ring 24 extends above the pole surface 35 and a second portion of the shunt ring 24 extends below the pole surface 35. The groove in the pole member allows the guide member to extend into the pole member This maintains the guide member 17 concentric with the pole member 14 so that the armature 16, which is guided by the guide member 17 is maintained concentric with the pole member 14.

The inner diameter of the shunt ring 24 is greater than the outer diameter of the armature 16, allowing the armature 16 to be moved substantially axially relative to the magnetic pole member 14, through the shunt ring 24 into engagement with the pole surface 35 of the pole member 14. This allows maximizing the working diameter of the pole face 35 and the working diameter of the armature face 40 that is coextensive with the pole face 35. Generally, the length of the stroke dictates the width of the shunt ring, i.e., the vertical height of the shunt ring as viewed in FIG. 2. That is, the width or height of the shunt ring above the pole surface is approximately equal to the width of the air gap 42.

When the armature is being driven from the unlatched position to the latched position, the shunt ring 24 bridges substantially the entire air gap 42 between the pole surface 35 of the pole member 14 and the armature surface 40 of the armature 16. The shunt ring 24 channels the magnetic flux between the armature 16 and the pole member 14, enhancing the coupling of magnetic flux between the pole member 14 and the armature 16. This results in increased magnetic force at a given level as compared to a solenoid of comparable size without the shunt ring.

Figure 4:
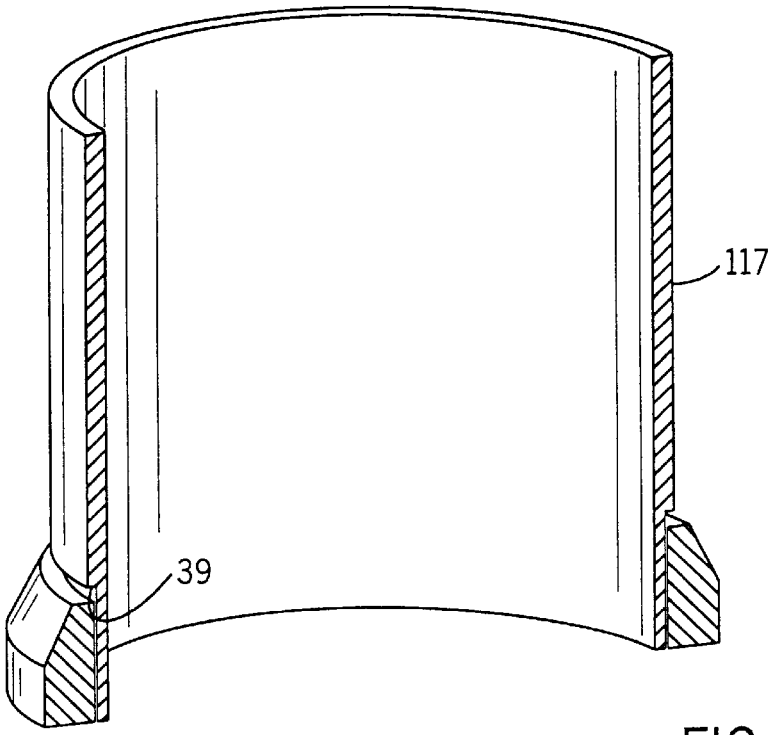
FIG. 4 is an enlarged, vertical section view of a guide member for use with the latching solenoid of FIG. 1, with a magnetic flux shunt member in accordance with a further embodiment shown partially extending into a recess of the guide member.

The armature 16 is isolated from the shunt ring 24 by the guide member 17 which is of a non-magnetic material. In one embodiment, the guide member 17 is a sleeve-like element. However, the guide member can include a reduced outer diameter portion as shown in FIG. 4. Referring to FIG. 4, which is a section view of a guide member 117 in accordance with a further embodiment, the guide member is a sleeve-like element Preferably, the guide member 117 includes a recess 39 near one end for receiving a portion of the shunt ring 24. For example, in one embodiment, the guide member 117 is formed of a section of brass tubing having a 0.020 inch wall thickness. By way of example, the outer diameter can be reduced to about 0.008 inch to 0.009 inch, for example. The shunt ring 24 extends into the reduced diameter portion of the guide member.

Referring again to FIGS. 1–3, the guide member 17 prevents the armature 16 from contacting the flux shunt ring 24. In addition, the guide member 17 (or 117) guides the armature 16 as the armature is driven between the latched and unlatched positions. Thus, for example, as the armature is driven from the unlatched position to the latched position, the guide member 17 substantially eliminates side loading which could cause the flat armature surface 40 of the armature 16 to become misaligned with the flat pole face 35 of the pole member 14, resulting in reduction of the latching force.

Figure 5:
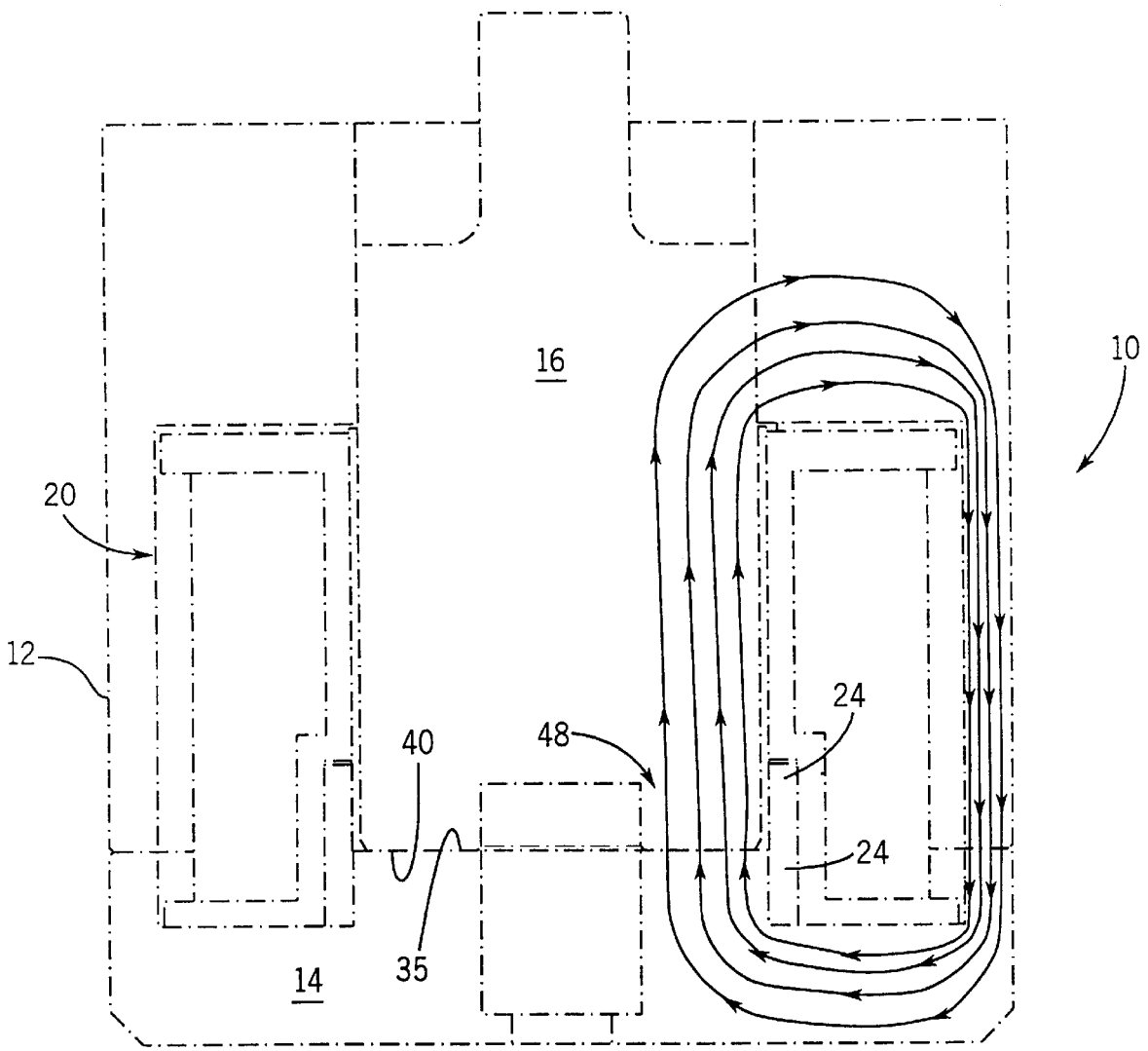
FIG. 5 is a sketch illustrating the magnetic fields for the latching solenoid of FIG. 1, when latched.

FIG. 5 is a simplified representation of the magnetic flux lines or paths for magnetic flux produced by the solenoid winding 22 for the latched condition of the latching solenoid 10. FIG. 5 shows only the magnetic flux lines at one side of the solenoid, it being understood that flux lines are produced around the full extent of the solenoid winding. For this condition, the armature 16 is positioned with the armature face 40 engaging the pole face 35. Consequently, there is substantially no gap between the opposing surfaces 35 and 40 of the pole member 14 and the armature 16 and the magnetic flux passes directly from the pole member 14 to the armature 14 as indicated by reference numeral 48.

Figure 6:
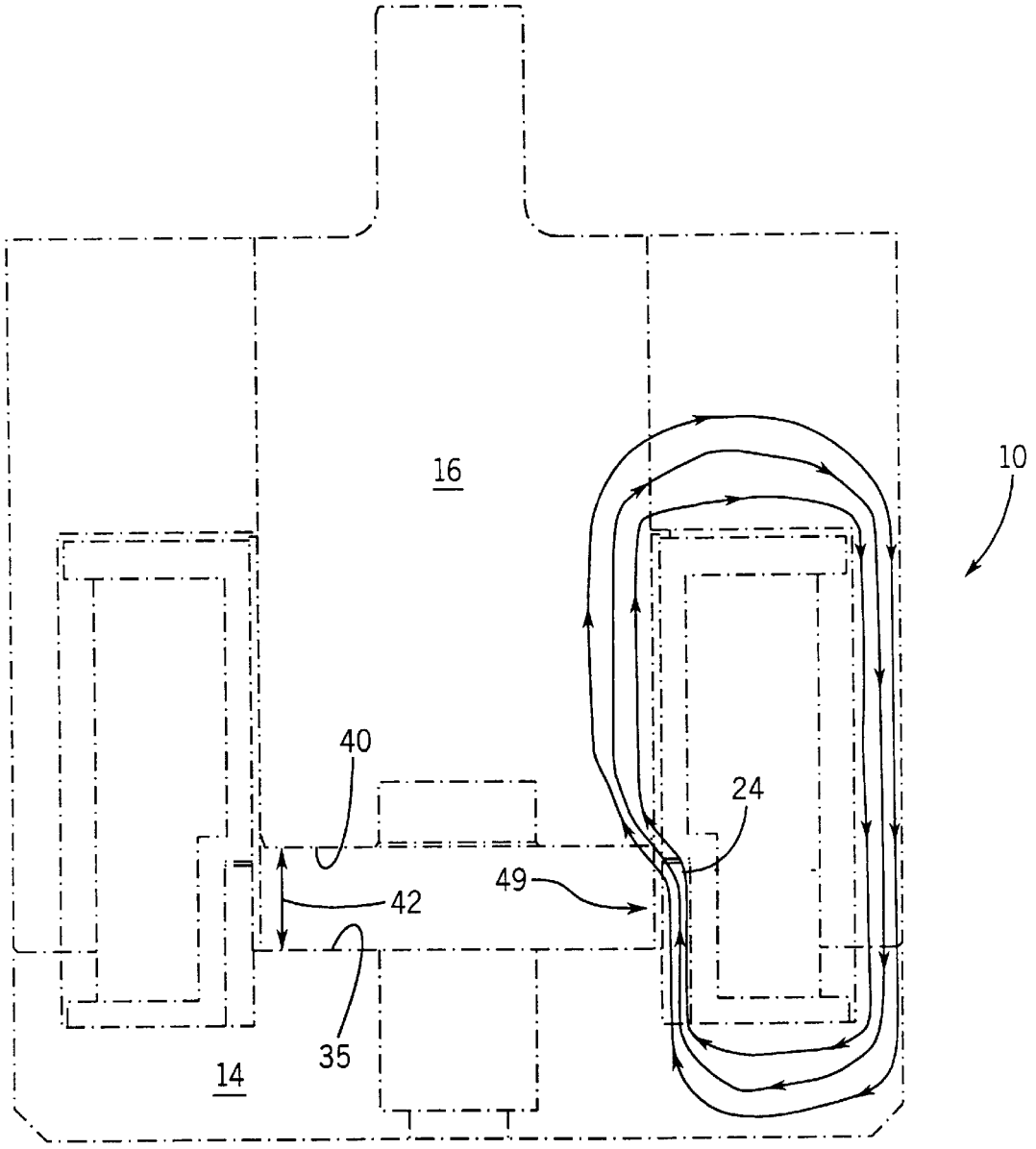
FIG. 6 is a sketch illustrating the magnetic fields for the full stroke condition for the latching solenoid of FIG. 1.

In contrast, with reference to FIG. 6, there is illustrated a simplified representation of the magnetic flux lines or paths for magnetic flux produced by the solenoid winding for the full stroke condition of the latching solenoid 10. For this condition, the armature 16 is positioned spaced apart from the pole member 14 with a gap 42 between the armature face 40 and the pole face 35. The flux shunt ring 24 provides a shunt path around the air gap 42 for the magnetic flux with the magnetic flux passing through the shunt ring from the pole member to the armature as indicated by reference numeral 49. Because the shunt ring 24 is of a soft steel, the shunt ring will exhibit higher permeabilty than the pole member and the armature so that some of the magnetic flux will pass through the shunt ring. This results in higher magnetic attractive forces, particularly at full stroke. Without the shunt ring 24, magnetic flux would have to pass through the relatively high reluctance air gap 42 that exists between the opposing surfaces of the armature 16 and the pole member 14 when the armature is moved out of contact with the pole member.

Digressing, a further factor contributing to increased magnetic attractive force is the use of a step wound coil which allows increasing the working area of the armature 16 and the pole member 14. The amount of attractive force which can be produced by this type of magnetic circuit is related to the coaxial diameters of the working surfaces 35 and 40 of the magnetic pole member 14 and the armature 16, the number "N" of turns of the solenoid coil assembly 20, and the current "I" applied to the solenoid winding 22. Thus, on the one hand, the configuration of the solenoid winding 22 is a factor in the higher magnetic force attraction provided between the magnetic pole member and the armature for the solenoid 10 because of the increased coaxial diameters of the armature and the pole member. Although the step-wound winding 22 results in a reduction of about 15% in coil power due to less winding space, there is an increase of about 30% in force for a winding of a given area because of the increase in the coextensive diameters of the magnetic pole member 14 and the armature 16.

The amount of attractive force which can be generated by this type of magnetic circuit is given by the relationship $F=kAB^2$ where A is the area of each of the coextensive portions 35 and 40 of the magnetic pole member 14 and the armature 16, B is the flux density produced by the solenoid winding 22, and k is a constant. The flux density is proportional to NI which is the product of the number of turns N of the solenoid winding 22 and the applied current I. Thus, the available force F is dependent upon the relationship between the coaxial diameters of the armature face 40 and the pole face 35.

Figure 7:
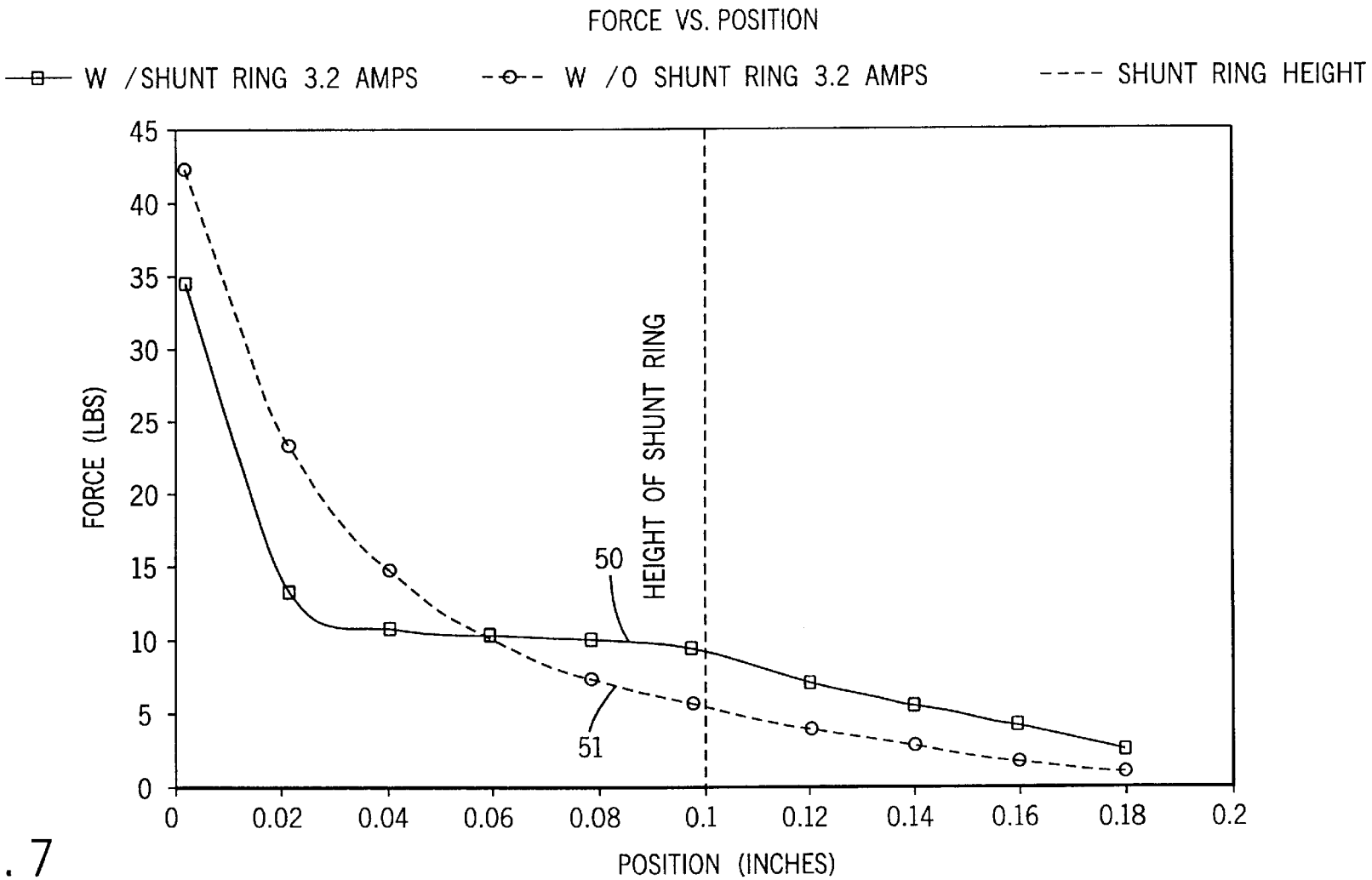
FIG. 7 shows graphs of attractive force as a function of displacement of the armature for the latching solenoid provided by the invention with the shunt member and for a latching solenoid without a shunt member.

Referring to the graphs of FIG. 7, the solid line curve 50 represents force, in pounds (lbs), as a function of displacement of the armature, in inches, for the latching solenoid 10 provided by the invention which includes the magnetic flux shunt ring 24. The dashed line curve 51 in FIG. 7 represents force as a function of displacement for a latching solenoid which is of the same construction as latching solenoid 10, but which does not include a shunt ring. The solenoid windings of both latching solenoids were energized by the same current at a level of 3.2 amperes. For latching solenoid 10, the length of portion of the shunt ring 24 extending beyond the pole surface 35 was approximately 0.100 inch. As is shown in FIG. 7, the force is substantially linear between about 0.020 inch and about 0.100 inch for the latching solenoid 10. In addition, the force for a 0.100 inch stroke provided for the latching solenoid 10 which includes the shunt ring, is approximately 10 lbs whereas the force for a 0.100 inch stroke provided for the comparable solenoid which does not include a shunt ring is less than about 7 lbs, and is approximately 65% of the force provided by latching solenoid 10. As is shown by the right hand portions of curves 50 and 51, when the stroke for both latching solenoids is increased to about 0.180 inch, the force produced decreases at the high end, but the force produced by the latching solenoid 10 is greater than the force produced by the latching solenoid that does not include a shunt ring.

As can be seen, the operating characteristic of the latching solenoid 10 provides a linear relationship between force and length of stroke from about 0.020 inch to about 0.100 inch due to the shunt ring 24. The upper limit of the linear range can be greater than or less than 0.100 inch with appropriate modifications, such as increasing or decreasing the height of the shunt ring, for example.

Figure 8:
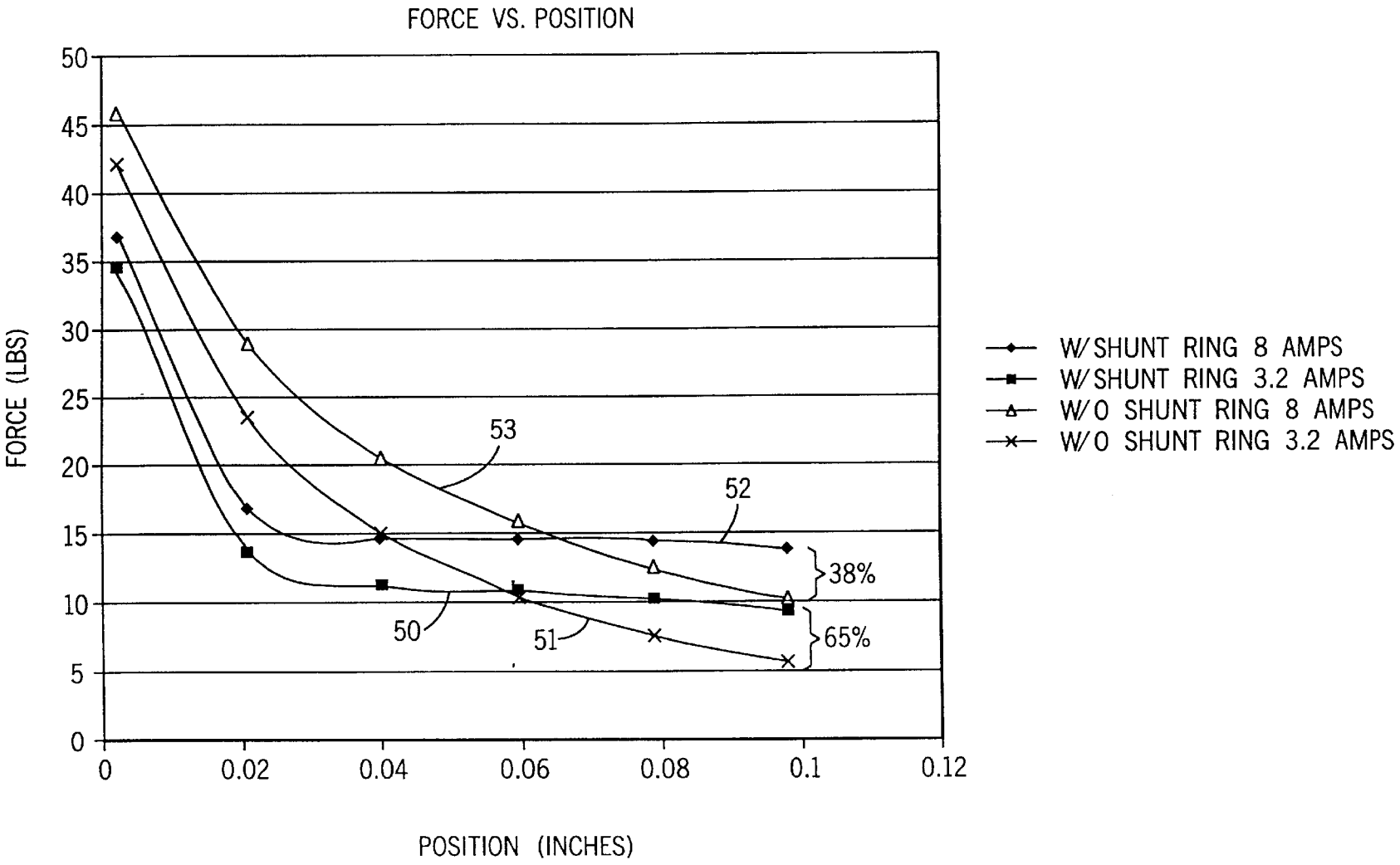
FIG. 8 shows graphs of attractive force as a function of displacement of the armature for the latching solenoid provided by the invention with the shunt member and for a latching solenoid without a shunt member.

Referring to FIG. 8, the same comparison between force and position for the latching solenoid 10 and a corresponding latching solenoid that does not include a shunt ring is illustrated for two different current levels. The curves 50 and 51 (FIG. 7) for a current level of 3.2 amperes are reproduced in FIG. 8 and are correspondingly numbered. In addition, FIG. 8 includes a curve 52 showing force as a function of displacement of the armature 16 for the latching solenoid 10 provided by the invention with the shunt ring for a current of 8 amperes. Curve 53 shows force as a function of displacement for the comparable latching solenoid but without a shunt ring. As can be seen, for a current level of 8 amperes, the attractive force produced by the latching solenoid 10 is 38% greater than that for the force produced by the comparable latching solenoid without a shunt ring.

Importantly, as can be seen by comparing curve 53 (for latching solenoid without a shunt ring) with curve 50 (for latching solenoid with a shunt ring), for the latching solenoid that does not include a shunt ring, a current level that is approximately 150% greater is required to produce the same attractive force that is provided by the latching solenoid 10 which includes a shunt ring in accordance with the invention.

Figure 9:
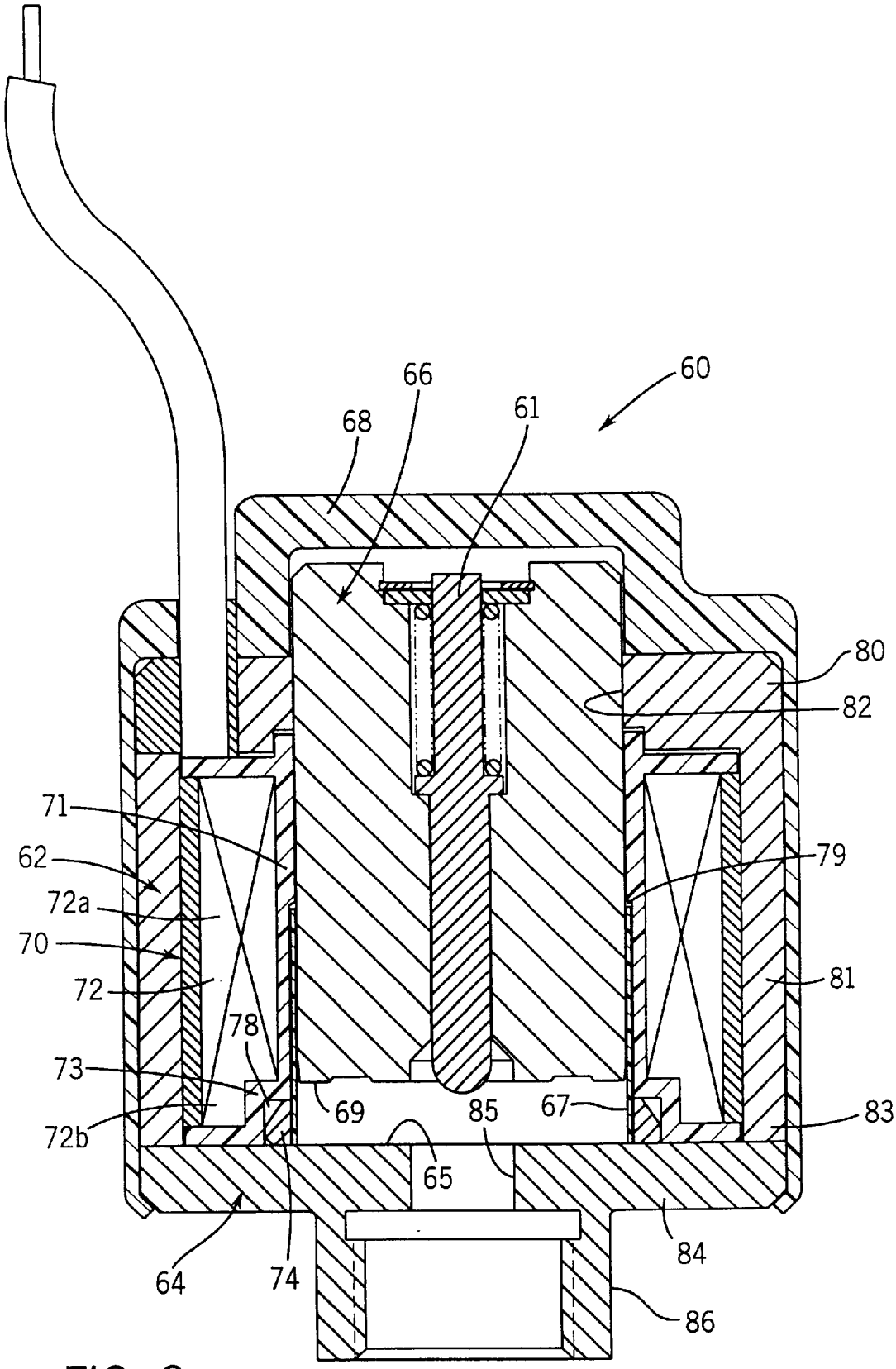
FIG. 9 is a vertical section view of a valve incorporating a further embodiment of a latching solenoid provided by the invention.

Referring to FIG. 9, there is shown a further embodiment of a latching solenoid 60 provided in accordance with the invention. The latching solenoid 60 is incorporated into a pinch valve for moving a pin 61 axially with respect to the body 62 of the latching solenoid.

The latching solenoid 60 is generally similar to latching solenoid 10 described above with reference to FIGS. 1–3. The latching solenoid 60 includes body 62, a magnetic pole member 64 having a generally flat pole surface 65, an armature 66 having a generally flat armature surface 69, a guide member 67 and a coil assembly 70. A cover 68 encloses the armature within the body 62. The latching solenoid 60 further includes a magnetic flux shunt structure 74. The body 62, the pole member 64 and the armature 66 can be of steel or other magnetic material. The guide member 67 and the cover 68 are preferably of an non-magnetic material.

The body 62 includes a base 80 and a tubular side wall 81 with an aperture 82 through the base through which extends the armature 66. The body 62 has an open end 83 on which is mounted the pole member 64 for closing the open end 83.

The magnetic pole member 64 includes a generally flat disc-like portion 84 with an axial center bore 85 through which the pin 61 is moved when the armature 66 is operated to its latching position. The pole member has a hub 86 which facilitates coupling the pinch valve to apparatus with which it is used. The coil assembly 70 and the shunt structure 74 can be supported on the inner surface of the pole member 64.

The armature 66 is supported within the body 62 for axial, reciprocating movement relative to the magnetic pole member 64. In one embodiment, residual magnetism maintains the armature 66 in a position to which it has been driven. However, the armature 66 can be maintained in a position to which it has been driven by a permanent magnet located in the magnetic flux path. For applications in which residual magnetism is used to maintain the armature in a position to which it is driven, the shunt structure preferably is of a soft magnetic material, such as a soft steel, and the armature, pole member and body are of a hard magnetic material, such as a hardened steel.

The solenoid coil assembly 70 is mounted in the interior of the body 62. The coil assembly 70 includes a step-wound solenoid winding 72 which is wound on a bobbin 71. The bobbin 71 can be formed with a step or shoulder 73 at one end. The solenoid winding includes a first winding portion 72*a* and a second winding portion 72*b* which has an inner diameter that is larger than the inner diameter of the first winding portion 72*a*.

The guide member 67 is interposed between the armature 66 and the shunt ring 74. In one embodiment, the guide member 67 is a sleeve-like element which is dimensioned and configured to be received in a recess 79 formed in the inner surface of the bobbin. This allows the guide member 67 to be interposed between the armature 66 and the shunt structure 74 without requiring a decrease in the outer diameter of the armature. In this way, maximum surface contact is provided between the armature face and the pole face 65 for the latched condition of the solenoid. The guide member 67 prevents the armature 16 from contacting the shunt structure 74. In addition, the guide member 67 guides the armature 66 as the armature 66 is driven between the unlatched and latched positions. Alternatively, the guide member 67 can include a recess in the manner of guide member 117 (FIG. 4) and with the bobbin either including the recess 79 or not including the recess 79. In this embodiment, the guide member 67 and the bobbin 71 maintain the armature 66 concentric with the pole member 64.

Figure 10:
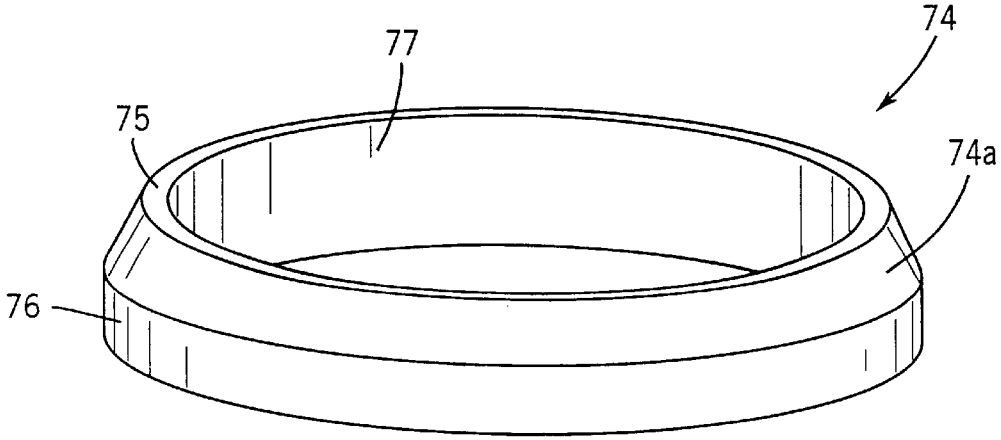
FIG. 10 is an enlarged perspective of a further embodiment of a shunt member for the latching solenoid of FIG. 9.

Referring also to FIG. 10, the shunt structure 74 comprises a ring-shaped member which is a separate element from the pole member and the armature. The shunt member or ring 74 has an edge 75 which is beveled inwardly from the outer surface 76 to the inner surface 77 of the shunt ring. The beveled edge of the shunt ring 74 results in increased the flux coupling between the magnetic pole member and the armature as compared to a straight edge. This not only increases the attractive force available, but also increases the speed of the response of the device. The shunt ring is received in a recess 78 defined by the step or shoulder 73 of the bobbin and adjacent to the pole face 65 near end 83 of the body. The shunt ring 74 is dimensioned to overlap the air gap 63 between the pole face 65 of the magnetic pole member and the armature face 69 of the armature 66 when the armature is in the unlatched position. The width (or vertical height as viewed in FIG. 9) of the shunt ring 74 is less than that for the shunt ring 24 of latching solenoid 10 because shunt ring 74 does not extend below the pole surface 65.

Figure 11:
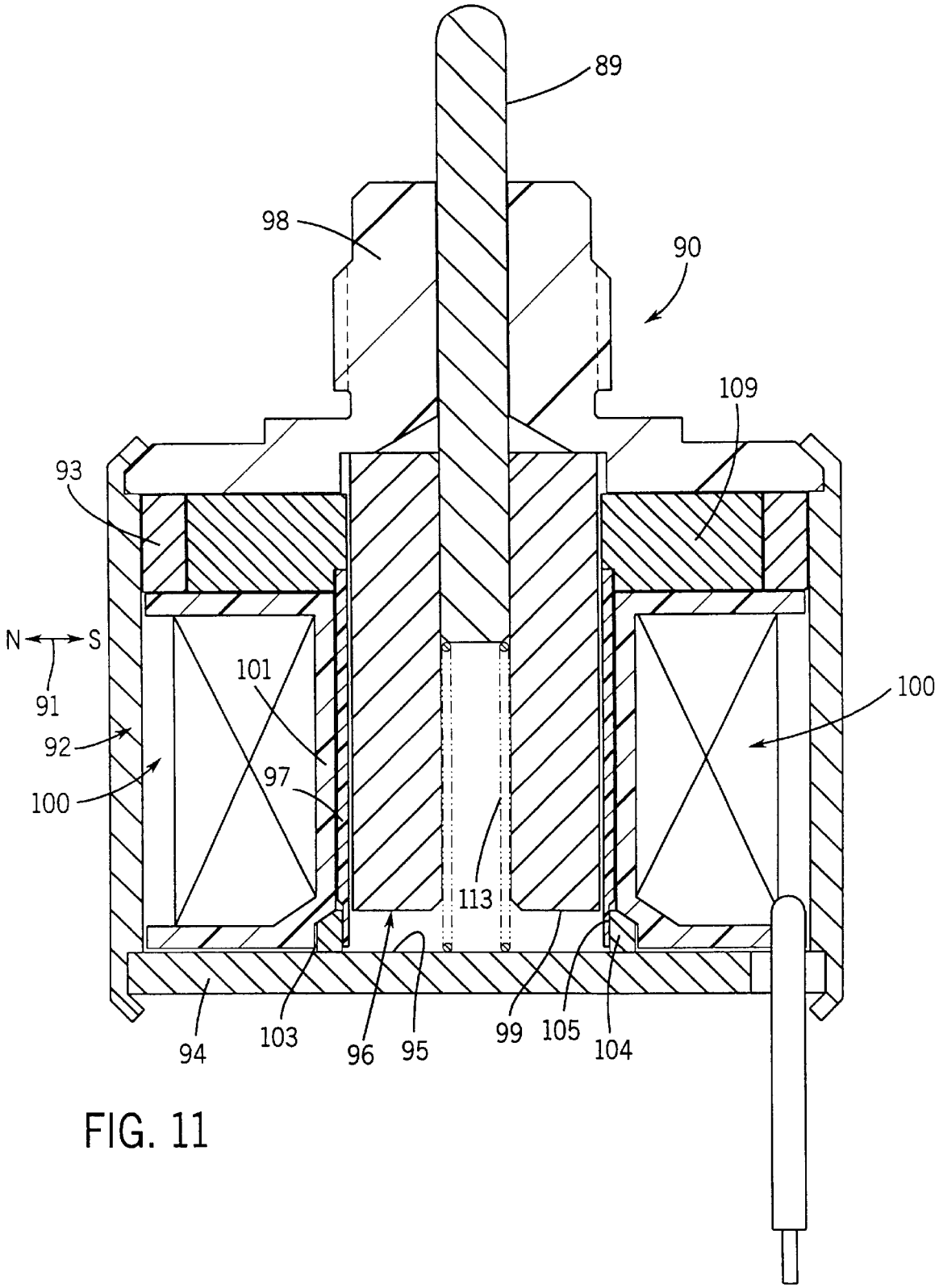
FIG. 11 is a vertical section view of a further embodiment of a latching solenoid provided by the invention and in which the latching function is provided by permanent magnet.

Referring to FIG. 11, there is shown a further embodiment of a latching solenoid 90 provided in accordance with the invention and which is incorporated into a valve for moving a pin 89 axially with respect to a body 92 of the latching solenoid.

The latching solenoid 90 includes body 92, a magnetic pole member 94 having a pole surface 95, an armature 96 having an armature surface 99, a guide member 97 and a coil assembly 100. The latching solenoid 90 further includes a magnetic flux shunt structure 104. The latching solenoid 90 is generally similar to solenoid 60 described above with reference to FIGS. 9–10. However, the armature is modified to carry the pin 89. Also, a cover 98 encloses the armature within the case. The body 92, the pole member 94 the armature 96 and the shunt structure 104 are of steel or other magnetic material. The guide member 97 and the cover 98 are of an non-magnetic material. The body 92, the magnetic pole member 94, the armature 96 and the magnetic flux shunt structure 104 are similar to correspondingly named elements of the latching solenoid 60 and accordingly will not be described in detail.

For latching solenoid 90, the latching mechanism for maintaining the armature 96 in a position to which it has been driven by the solenoid winding is provided by a permanent magnet 93. The permanent magnet 93 is located in the magnetic flux path for the magnetic flux produced by the solenoid winding 102. In one embodiment, the permanent magnet 93 is a ring-shaped magnet and is oriented with its north pole disposed adjacent to the body and its south pole disposed near the armature, as represented by the arrow 91. A spacer washer 109 of a magnetic material, such as steel, is interposed between the inner surface of the permanent magnet 93 and the guide member 97. Although in one embodiment the latching solenoid 90 includes a permanent magnet for providing the latching function, residual magnetism can be used to maintain the armature 96 in a position to which it has been driven. For applications in which residual magnetism is used to maintain the armature in a position to which it is driven, the shunt structure preferably is of a soft magnetic material, such as a soft steel, and the armature, pole member and body are of a hard magnetic material, such as a hardened steel.

The shunt structure 104 comprises a ring-shaped member or shunt ring 104 having an edge 105 which is beveled inwardly in the manner of shunt ring 74, as shown in FIG. 10 for the latching solenoid 60 of FIG. 9. The shunt ring is separate element from the pole member and the armature. The beveled edge 105 maximizes the flux coupling between the magnetic pole member and the surface of the pole armature face. The shunt ring 104 is dimensioned to overlap the air gap between the pole surface 95 and the armature surface 99 when the armature is in the unlatched or full stroke position.

The coil assembly 100 of the latching solenoid 90 includes a bobbin 101 that has a recess 103 for receiving the shunt ring 104, and which substantially conforms to the shape of the beveled edge of the shunt ring 104. This arrangement does not require that the solenoid winding 102 of the coil assembly be step wound, although there is a slight distortion in the coil in the proximity of the recess. The amount of winding lost is significantly less than that for a step wound winding as can be seen by comparing FIGS. 11 and 9, for example.

In this embodiment, the upper portion of the guide member 97 is interposed between armature 96 and the washer 109, the intermediate portion of the guide member is interposed between the armature and the bobbin 101, and the lower portion of the guide member is interposed between the armature and the shunt ring 104. The guide member 97 can be a sleeve-like element which is dimensioned and configured to fit in a gap between the armature 96 and the bobbin 101, in the manner of guide member 67 (FIG. 9), without requiring a decrease in the outer diameter of the armature. In this way, maximum surface contact is provided between the armature face and the pole face for the latched condition of the solenoid. In addition, the guide member 97 can include a reduced outer diameter portion at one end for receiving a portion of the shunt ring 104 and a reduced outer diameter portion at its other end for receiving a portion of the spacer washer 109. The guide member 97 prevents the armature 96 from contacting the flux shunt ring 104. In addition, the guide member 97 guides the armature 96 as the armature 96 is driven between the unlatched and latched positions.

Referring to FIGS. 12–16, there is shown a further embodiment of a solenoid 110 provided by the invention. In this embodiment, the solenoid 110 includes a shunt structure 124 (FIG. 14) in the form of a shunt washer. In addition, the bobbin 121 of the coil assembly 120 guides the armature 116 in its movement between an full stroke and retracted positions, and the bobbin isolates the shunt structure 124 of the solenoid 110 from the armature. Thus, the bobbin provides the functions of the guide member of the embodiments of the latching solenoids described above. Moreover, the solenoid 110 is not latched in a position to which it has been driven.

The solenoid 110 includes a body or case 112, armature 116, and coil assembly 120 for positioning the armature 116 relative to the body 112. In this embodiment, the base 131 of the body 112 provides the function of a pole member. The coil assembly 120 includes a solenoid winding 122 wound on the bobbin 121. The solenoid further includes a bias spring 126 (FIG. 17), a washer 128 and a washer 130. The body 112, the armature 116, the shunt structure 124 and the washers 128 and 130 can be of steel or other magnetic material.

Considering the solenoid 110 in more detail, the body 112 is a generally cup-shaped member having a generally flat base 131 and an annular side wall portion 132. The base 131 has an aperture 133 therethrough. The side wall 132 includes four notches 134–137 in the outer edge. In one embodiment, the notches 134–137 are equi-spaced around the periphery of the side wall 132.

Figure 23:
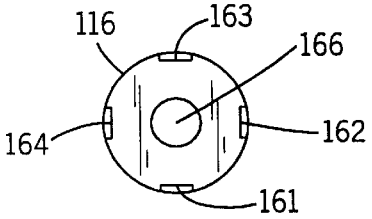
FIG. 23 is a top plan view of an armature of the solenoid of FIG. 12.
Figure 24:
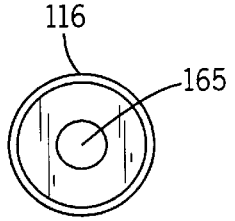
FIG. 24 is a bottom plan view of the armature of FIG. 23.

Referring also to FIGS. 23–24, the armature 116 is a generally cylindrical member. In one embodiment, the armature 116 includes four axial grooves 161–164 in the outer surface thereof, each terminating in a shoulder 170. The grooves 161–164 are equi-spaced about the periphery of the armature. The armature includes a conical-shaped end 165 and a reduced diameter end 166 with a peripheral groove 167 near end 166. The reduced diameter end 166 is adapted for coupling to a mechanism being actuated by the solenoid 110.

Figure 18:
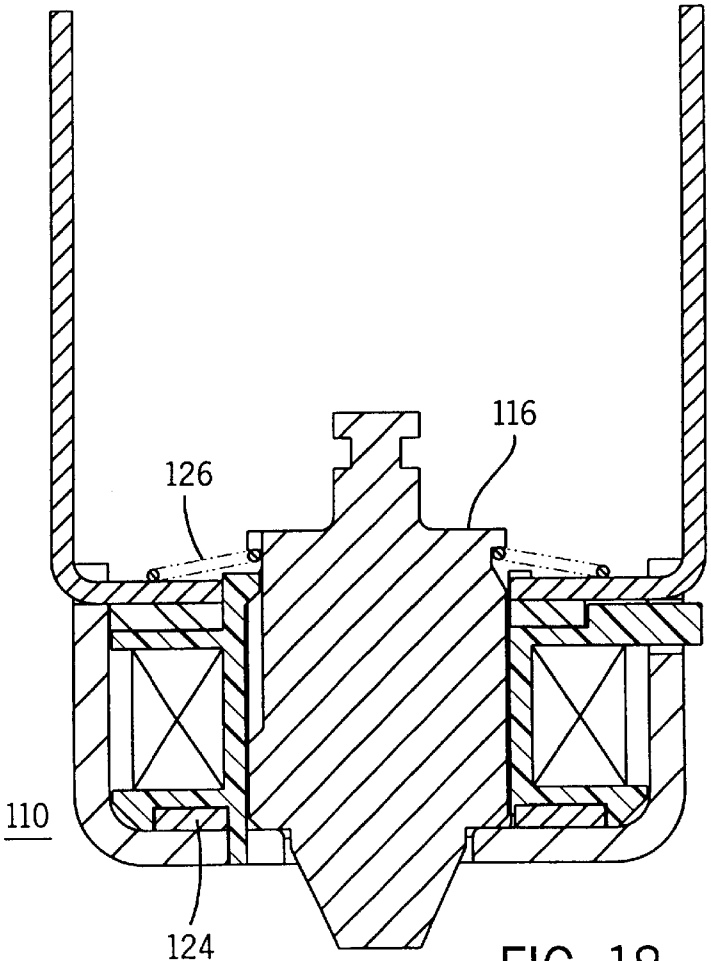
FIG. 18 is a view similar to that of FIG. 17 and with the armature shown in the full stroke position.
Figure 17:
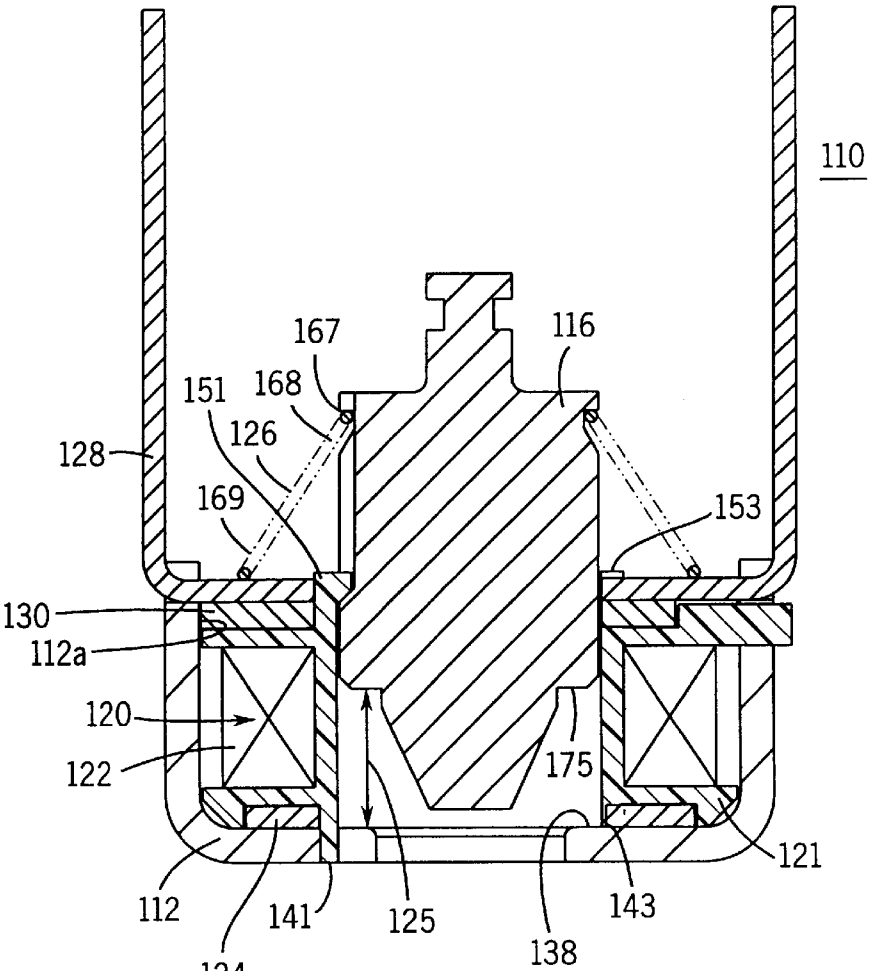
FIG. 17 is a section view taken along the line 17—17 of FIG. 12.

The armature 116 is mounted in the body 112 for reciprocating axial movement relative to the body between a full stroke position, shown in FIG. 17, and a retracted position shown in FIG. 18. The armature is biased to the full stroke position by the bias spring 126. The bias spring has one end 168 located in the groove 167 and a second end 169 engaging the washer 128. The armature 116 is driven by the solenoid coil 122 to the retracted position against the force of the bias spring 126.

Figure 12:
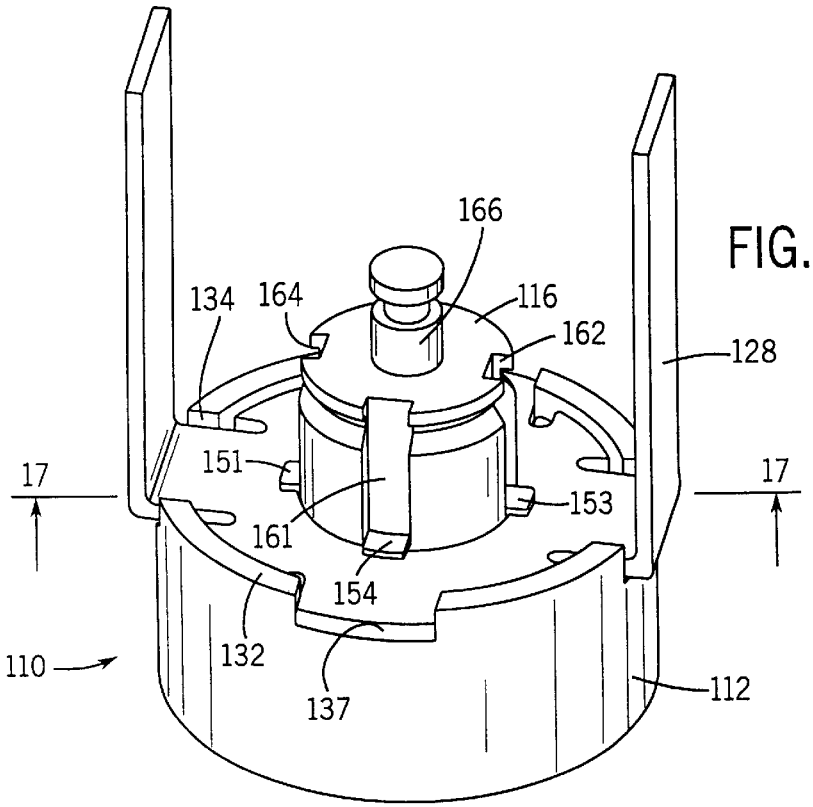
FIG. 12 is a perspective view of a further embodiment of a solenoid provided by the invention including a magnetic flux shunt structure configured as a shunt washer.
Figure 13:
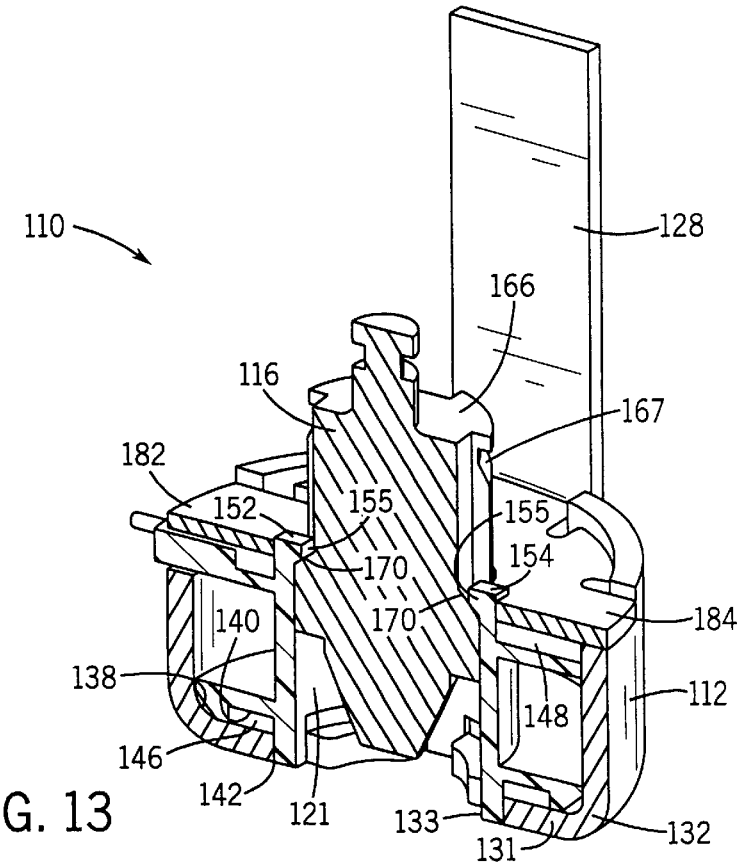
FIG. 13 is a perspective view, in section, of the solenoid of FIG. 12, rotated 90° and with the solenoid winding and the shunt washer not shown to simplify the drawing.
Figure 14:
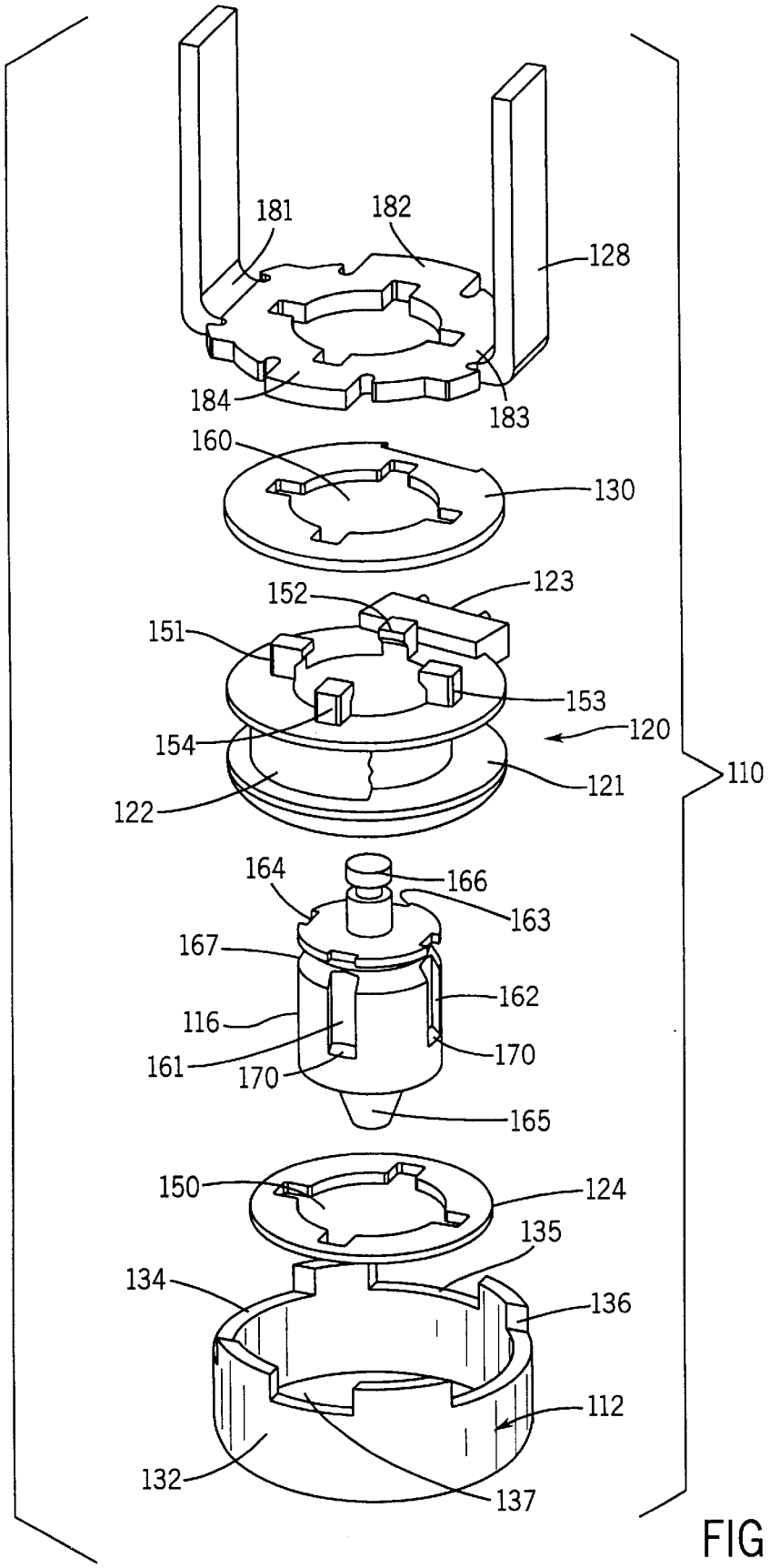
FIG. 14 is an exploded perspective view of the solenoid of FIG. 12.
Figure 15:
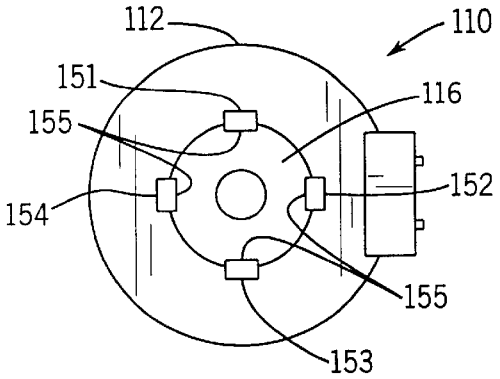
FIG. 15 is a top plan view of the solenoid of FIG. 12.
Figure 16:
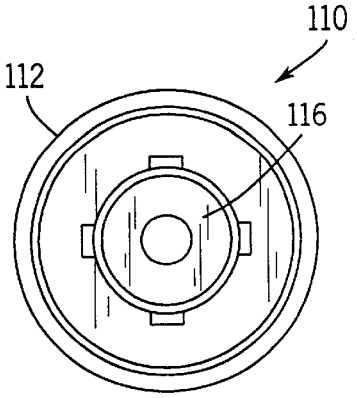
FIG. 16 is a bottom view, of the solenoid of FIG. 12.

Referring to FIGS. 12–14, 17 and 21–22, the bobbin 121 isolates the armature 116 from the shunt washer 124 and guides the armature as it is moved between full stroke and retracted positions as will be shown. The bobbin 121 is dimensioned to be positioned within the body 112, resting on the inner surface 138 of the base 131. The bobbin 121 includes an annular recess 140 which cooperates with the surface 132 to define an annular cavity or compartment 146 (FIG. 13) for containing the shunt washer 124 (not shown in FIG. 13). The inner surface of the bobbin 121 defines a guide surface for the armature. The guide surface includes four extensions 141–144 (FIG. 22) which project from the bobbin 121 at one end 147 of the bobbin (the lower end as viewed in FIG. 17), and four extensions 151–154 (FIG. 21) which project from the bobbin 121 at the opposite end(the upper end as viewed in FIG. 17). As shown in FIG. 13, the shoulders 170 on the armature 116 engage the extensions, such as extensions 152 and 154, which function as travel limit stops for the armature as the armature is moved to its full stroke position under the force of the bias spring 126. At least the extensions 151–154 include projections 155 which cooperate with the armature for guiding the armature in its movement between its full stroke and retracted positions. The coil assembly can include a plug-in type connector 123 for the leads of the solenoid winding. The bobbin 121 can be made of plastic and preferably is molded as a one piece unit including the extensions 141–144 and 151–154.

Figure 19:
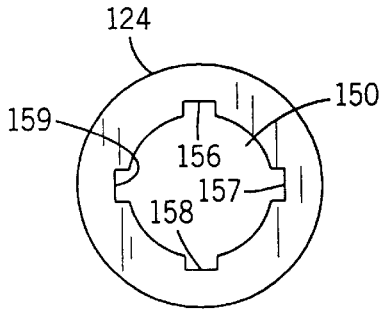
FIG. 19 is a top plan view of a shunt washer of the solenoid of FIG. 12.
Figure 20:
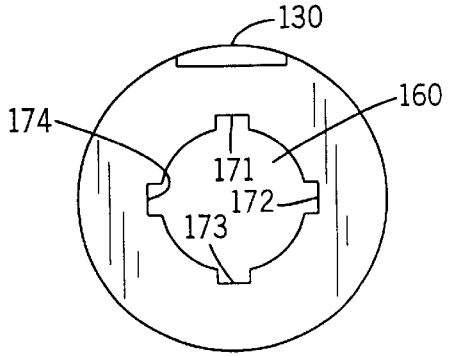
FIG. 20 is a top plan view of a spacer washer of the solenoid of FIG. 12.
Figure 21:
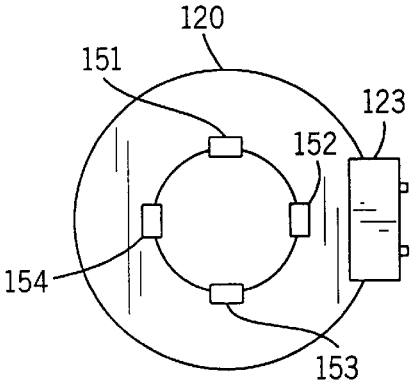
FIG. 21 is a top plan view of a bobbin of the solenoid of FIG. 12.
Figure 22:
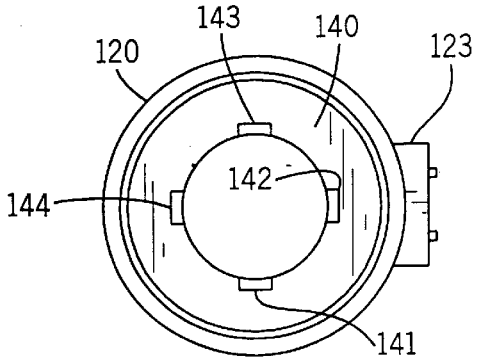
FIG. 22 is a bottom plan view of the bobbin of FIG. 19.

Referring to FIGS. 12, 14, 17 and 19, the shunt washer 124 is a flat annular member having a central opening 150 therethrough. In one embodiment, the shunt washer 124 is 0.050 inch in width. The shunt washer 124 includes four notches 156–159 equi-spaced along its inner periphery as shown in FIG. 19. The notches 156–159 are dimensioned to receive the extensions 141–144, respectively, when the shunt washer is located in the compartment 146. The shunt washer 124 bridges a portion of the air gap 125 between opposing surfaces of the body 112 and the armature 116, enhancing the coupling of magnetic flux between the body 112 and the armature 116. The shunt washer is a separate element from the body and the armature The inner diameter of the shunt washer 124 is greater than the outer diameter of the armature 116 so that the armature is isolated from contact with the shunt washer 124 as shown in FIG. 17, for example.

Referring to FIGS. 12, 14, 17 and 20, the spacer washer 130 is a flat annular member having a central opening 160 therethrough. The spacer washer includes four notches 171–174 equi-spaced along its inner periphery as shown in FIG. 17. The spacer washer 130 is received in a compartment 140 (FIG. 13) defined by a shoulder 121a of the bobbin 121 and the side wall 112*a* (FIG. 17) of the body 112. The notches 171–174 are dimensioned to receive the extensions 151–154, respectively, when the spacer washer 130 is located in compartment 140. Washer 128 includes notches 181–184, corresponding to notches 171–174 for receiving extensions 151–154, and tab pairs 188 and 189. Tab pairs 188 and 189 extend outward radially and are received in the notches 134,135 and 136,137 in side wall 132.

Figure 25:
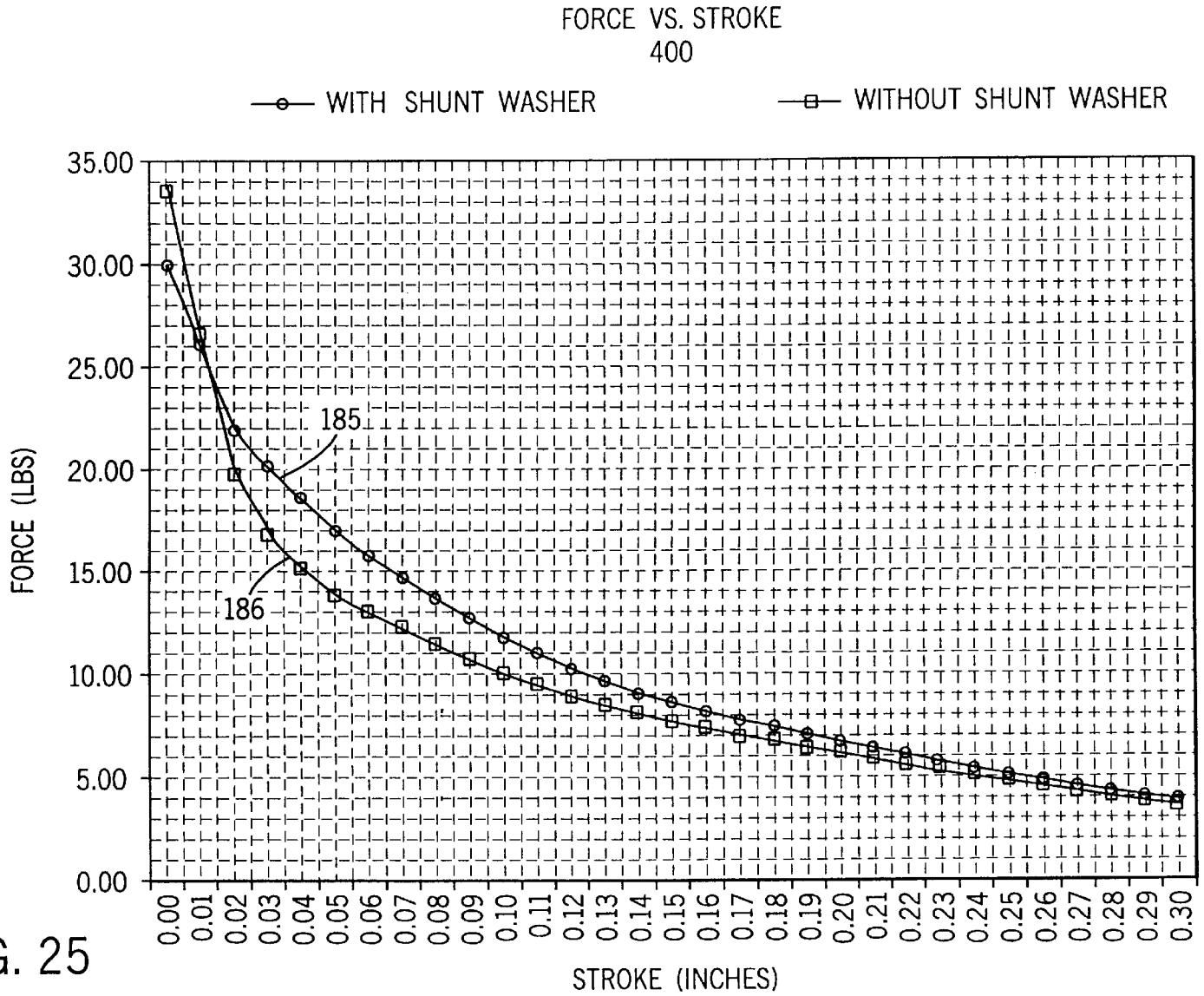
FIG. 25 show graphs of attractive force as a function of displacement of the armature for the solenoid of FIGS. 12–24 which includes a shunt washer and for a solenoid without a shunt washer.

Referring to the graphs of FIG. 25, the curve 185 represents force, in pounds (lbs), as a function of displacement of the armature, in inches, for solenoid 110 which includes magnetic flux shunt washer 124. The curve 186 in FIG. 25 represents force as a function of displacement for a solenoid which is of the same construction as solenoid 110, but which does not include a magnetic flux shunt washer. The solenoid windings of both latching solenoids were energized by the same current at a level of about 16 amperes. For solenoid 110, the width of shunt washer 124 was approximately 0.050 inch. As can be seen by comparing curves 185 and 186, the force produced by solenoid 110 is approximately 3 to 3.5 pounds greater than the force produced by the comparable solenoid without a magnetic flux shunt washer over a range of about 0.040 inch and 0.060 inch and is approximately 23% greater than the force provided by the comparable solenoid.

Figure 26:
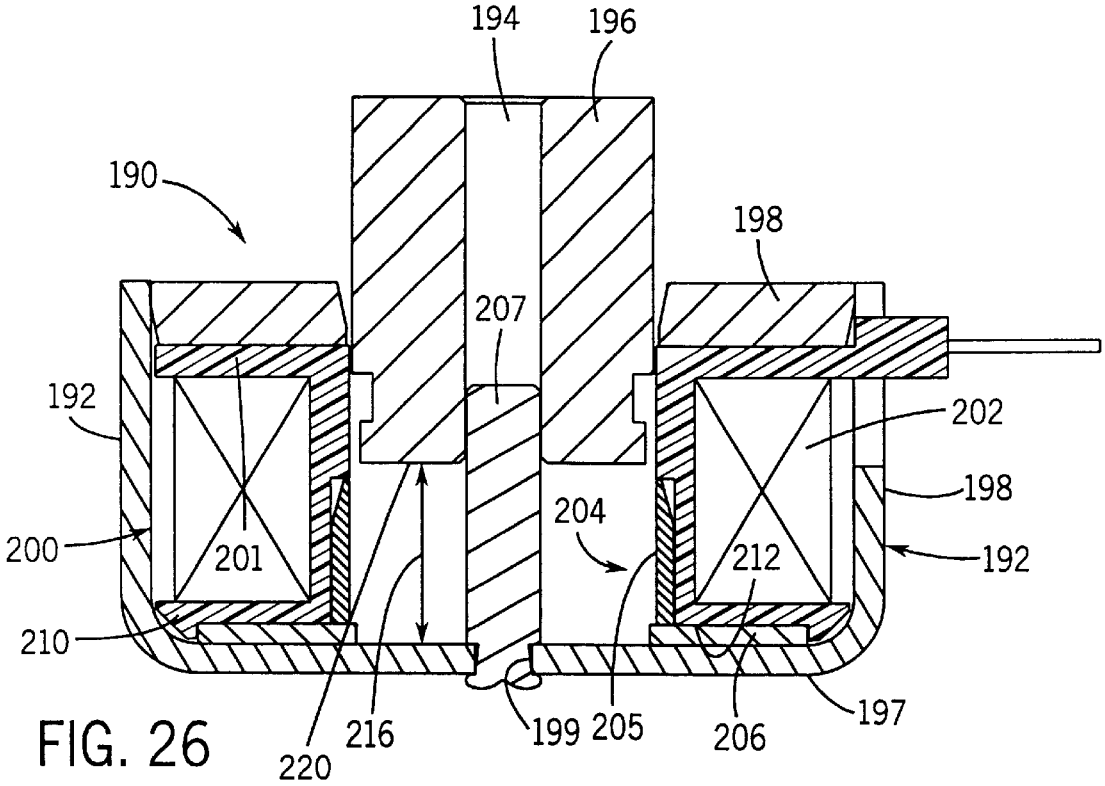
FIG. 26 is a vertical section view of a further embodiment of a solenoid provided by the invention.
Figure 27:
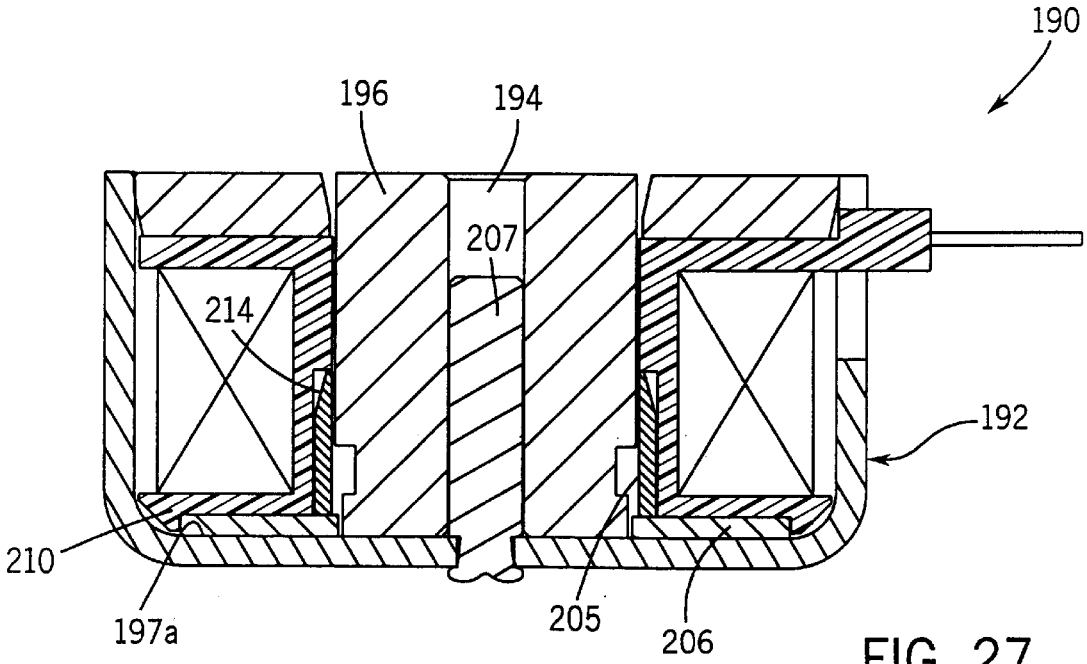
FIG. 27 is a view similar to that of FIG. 26, and with the armature shown in the full stroke position.

Referring to FIGS. 26–27, in accordance with a further embodiment of the invention, a solenoid 190 includes a shunt structure, indicated generally at 204, which includes a shunt ring 205 and a shunt washer 206. In this embodiment, the solenoid 190 is not latched in a position to which it has been driven. The elements which comprise the shunt structure are separate elements from the body and the armature The solenoid 190 includes a body or case 192, an armature 196, and a coil assembly 200 for positioning the armature 196 relative to the body 192. The coil assembly 200 includes a solenoid winding 202 wound on a bobbin 201. The solenoid 190 further includes a washer 198. The body 192, the armature 196, the washer 198, and the shunt ring 205 and shunt washer 206 can be of steel or other magnetic material.

In this embodiment, a guide pin 207, which is secured to the body 192, cooperates with the armature 196 to prevent the armature from contacting the shunt structure 204, as the armature is moved. This function effectively isolates the armature from the shunt structure 204 as the armature is moved between a full stroke position, shown in FIG. 26, and a retracted position, shown in FIG. 27. Also, in this embodiment, the base 197 of the body 112 provides the function of a magnetic pole member.

Considering the solenoid 190 in more detail, the body 192 includes a generally flat base 197 and an annular side wall portion 198. The base 197 has an aperture 199 therethrough in which the guide pin is secured in a suitable manner, such as by staking one end of the guide pin to the base 197.

The bobbin 201 is dimensioned to be positioned within the body 192, resting on the inner surface of the base 197. The bobbin 201 includes an outer peripheral ridge 210 (FIG. 27) at its lower end which rests on the inner surface 197*a* of the base 197, spacing the bobbin 201 above the inner surface of the base, defining an annular cavity or compartment 212 for containing the shunt washer 206. In addition, the inner surface of the bobbin which faces the armature 196 includes an annular recess 214 (FIG. 27) which contains the shunt ring 205. The bobbin 201 can be molded of plastic.

The armature 196 is a generally cylindrical member having an axial opening 194 therethrough which receives the guide pin 207. The armature 196 is mounted in the body 192 for reciprocating axial movement relative to the body between a full stroke position shown in FIG. 25 and a retracted position shown in FIG. 26. The armature can be biased to the full stroke position by a bias spring (not shown). The armature 196 is driven by the solenoid winding 202 to the retracted position against the force of the bias spring.

The shunt ring 205 can be similar to shunt ring 24 shown in FIGS. 1–3. The shunt ring 205 bridges a substantial portion of the air gap 216 between the surface portion 218 of the body and the armature surface 220 of the armature 196. The shunt ring channels the magnetic flux between the body 192 and the armature 196, enhancing the coupling of magnetic flux between the body 192 and the armature 196 when the armature is being driven to the retracted position.

The shunt washer 206 can be similar to shunt washer 124 shown in FIG. 12, the shunt washer 206 including a central opening, corresponding to opening 150 of washer 124, therethrough. The shunt washer 206 is interposed between the lower surface 226 of the bobbin 201 and the inner surface of the body 192. The shunt washer 206 engages shunt ring 205 near the inner edge of the shunt washer 206. The shunt washer 206 bridges a small portion of the air gap 216 between opposing surfaces of the body 192 and the armature 196, enhancing the coupling of magnetic flux between the body 192 and the armature 196.

The magnetic flux shunt structure provided by the invention can be incorporated into any type of control device having a movable armature or the like. The magnetic flux shunt structure results in increased attractive force produced as compared to a comparably sized solenoid which does not include a shunt structure. Alternatively, a lower current level can be used to energize the solenoid provided by the present invention, producing a attractive force that is comparable to that produced by a conventional solenoid that is energized at a higher current level. Moreover, the magnetic force that is produced is linear over a greater portion of the force stroke characteristic, particularly at the high end portion of the force-stroke curve.

Although exemplary embodiments of the present invention have been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A solenoid comprising:

a pole member of a magnetic material, the pole member including a pole face;

an armature of a magnetic material, the armature being adapted for movement relative to the pole face between first and second positions, the armature including an armature end portion having an armature face opposing the pole face, the armature end portion being spaced apart from the pole face defining an air gap when the armature is in the first position and the armature face engaging the pole face when the armature is in the second position;

a coil assembly for positioning the armature relative to the pole member; and a magnetic shunt structure located adjacent to said pole face, the magnetic shunt structure being separate from the pole member and including at least one magnetic shunt member of a magnetically permeable material, the armature being movable relative to the magnetic shunt member, the magnetic shunt member engaging the pole member adjacent to said pole face and being configured and arranged to shunt at least a portion of the air gap when the armature is in the first position to provide a low reluctance magnetic flux path between the pole member and the armature, wherein the coil assembly includes a step-wound coil, the step-wound coil including a first winding portion having a first inner diameter, and a second winding portion having a second inner diameter which is larger than the first inner diameter and which is larger than an outer diameter of said armature end portion, defining a region of increased diameter for containing at least a portion of the shunt member, the shunt member having a minimum inner diameter that is greater than the outer diameter of the armature and the outer diameter of the pole face, and the outer diameter of the armature face corresponding to the outer diameter of the pole face, thereby maximizing the working diameter of the pole face and the working diameter of the armature face that is coextensive with the pole face.

2. The solenoid according to claim 1, and further comprising a guide member of a non-magnetic material, the guide member being configured and arranged for guiding the armature in its movement relative to the member to prevent the armature from engaging the magnetic shunt member.

3. The solenoid according to claim 2, wherein the guide member cooperates with the coil to define a compartment for containing the magnetic shunt member.

4. The solenoid according to claim 1, wherein the magnetic shunt member comprises an annular element having a peripheral side wall defining a central opening.

5. The solenoid according to claim 4, wherein the side wall of the annular element has a beveled edge.

6. The solenoid according to claim 4, and including a further magnetic shunt member interposed between said annular element and the surface of the pole member.

7. The solenoid according to claim 1, wherein the width of the portion of the shunt member extending above the pole face is approximately equal to the width of the air gap.

8. The solenoid according to claim 1, wherein the coil assembly defines a recess containing at least a portion of the magnetic shunt member.

9. The solenoid according to claim 1, wherein the armature is latched in one of said first and second positions by the effects of residual magnetism.

10. The solenoid according to claim 1, and including a permanent magnet in the magnetic flux path, the permanent magnet maintaining the armature latched in one of said first and second positions.

11. The solenoid according to claim 1, wherein the magnetic shunt member comprises a ring.

12. A solenoid comprising:

a pole member of a magnetic material, the pole member including a pole end portion having a pole face; an armature of a magnetic material, the armature being adapted for movement relative to the pole member between first and second positions, the armature including an armature end portion having an armature face opposing the pole face, the armature face being spaced apart from the pole face defining an air gap when the armature is in the first position and the armature face engaging the pole face when the armature is in the second position;

a coil assembly energizable for creating magnetic flux along a magnetic flux path for moving the armature relative to the pole member;

a magnetic shunt member located adjacent to said pole end portion, the magnetic shunt member being of a magnetically permeable material and being configured and arranged to shunt at least a portion of the air gap when the armature is in the first position for providing a low reluctance magnetic flux path between the pole member and the armature, wherein the shunt member has one end flush with the pole member; and a guide member of a non-magnetic material, the guide member interposed between the armature and the magnetic shunt member for guiding the armature in its movement relative to the pole member to prevent the armature from engaging the magnetic shunt member as the armature is moved between the first and second positions, wherein the coil assembly includes a step-wound coil, the step-wound coil including a first winding portion having a first inner diameter, and a second winding portion having a second inner diameter which is larger than the first inner diameter and which is larger than an outer diameter of said armature end portion, defining a region of increased diameter containing the shunt member.

13. The combination comprising:

a movable member; and a solenoid including a pole member of a magnetic material defining a pole face;

a magnetic shunt structure of a magnetic material located adjacent to the pole face, the magnetic shunt structure being separate from the pole member and engaging the pole member adjacent to the pole face;

an armature of a magnetic material, the armature being adapted for movement relative to the pole member, the armature being coupled to the movable member for moving the movable member, the armature having an end portion defining an armature face, the magnetic shunt structure providing a low reluctance path between the pole member and the armature when the armature is spaced apart from the pole member; and a coil assembly for positioning the armature relative to the pole face, the coil assembly including a step-wound coil, the step-wound coil including a first winding portion having a first inner diameter, and a second winding portion having a second inner diameter which is larger than the first inner diameter and which is larger than an outer diameter of said armature end portion, defining a region of increased diameter for containing at least a portion of the magnetic shunt structure, the shunt structure having a minimum inner diameter that is greater than the outer diameter of the armature and the outer diameter of the pole face, and the outer diameter of the armature face corresponding to the outer diameter of the pole face, thereby maximizing the working diameter of the pole face and the working diameter of the armature face that is coextensive with the pole face.

* * * * *